US012703959B2

(12) United States Patent
Okada et al.

(10) Patent No.: US 12,703,959 B2
(45) Date of Patent: Aug. 11, 2026

(54) AUTONOMOUS DRIVING DEVICE FOR WORK MACHINE

(71) Applicants: HIROSHIMA UNIVERSITY, Higashi-Hiroshima (JP); KOBELCO CONSTRUCTION MACHINERY CO., LTD., Hiroshima (JP)

(72) Inventors: Tomofumi Okada, Hiroshima (JP); Toru Yamamoto, Hiroshima (JP); Kazushige Koiwai, Hiroshima (JP); Koji Yamashita, Hiroshima (JP)

(73) Assignees: HIROSHIMA UNIVERSITY, Higashi-Hiroshima (JP); KOBELCO CONSTRUCTION MACHINERY CO., LTD., Hiroshima (JP)

( * ) Notice: Subject to any disclaimer, the term of this patent is extended or adjusted under 35 U.S.C. 154(b) by 522 days.

(21) Appl. No.: 18/251,319

(22) PCT Filed: Oct. 21, 2021

(86) PCT No.: PCT/JP2021/038991
§ 371 (c)(1),
(2) Date: May 1, 2023

(87) PCT Pub. No.: WO2022/097499
PCT Pub. Date: May 12, 2022

(65) Prior Publication Data

US 2023/0399812 A1 Dec. 14, 2023

(30) Foreign Application Priority Data

Nov. 9, 2020 (JP) ..... 2020-186601

(51) Int. Cl.
*E02F 3/43* (2006.01)
*E02F 9/20* (2006.01)
*E02F 9/26* (2006.01)

(52) U.S. Cl.
CPC ..... *E02F 3/437* (2013.01); *E02F 9/2029* (2013.01); *E02F 9/265* (2013.01)

(58) Field of Classification Search
CPC ..... E02F 3/437; E02F 9/2029; E02F 9/265
See application file for complete search history.

(56) References Cited

U.S. PATENT DOCUMENTS 6,108,949 A 8/2000 Singh et al.
2015/0240453 A1* 8/2015 Jaliwala ..... G01S 19/14 701/50

(Continued)

FOREIGN PATENT DOCUMENTS

EP 3 102 744 12/2016
JP 2001-32330 A 2/2001

(Continued)

OTHER PUBLICATIONS

International Search Report issued Dec. 21, 2021 in PCT/JP2021/038991 filed on Oct. 21, 2021 3 pages.

(Continued)

*Primary Examiner* — Sahar Motazedi
(74) *Attorney, Agent, or Firm* — Oblon, McClelland, Maier & Neustadt, L.L.P.

(57) ABSTRACT

An automatic operating device includes: a position estimation part that includes an interaction model, and calculates, as estimative position data, actual position data corresponding to force data which is input; a force computation part that includes a force computation model, calculates force data corresponding to a deviation which is input, and inputs the force data to the position estimation part; a database that stores a base parameter that is a parameter having been calculated in past; and a parameter setting part that calculates, on the basis of the base parameter, a target parameter corresponding to each of a norm y(t) of an actual position and a norm u(t) of a force, and sets the target parameter to (Continued)

a parameter of each of the interaction model and the force computation model.

9 Claims, 16 Drawing Sheets

(56) References Cited

U.S. PATENT DOCUMENTS

| | | | | |
|---|---|---|---|---|
| 2018/0135273 | A1 | 5/2018 | Tsuji | |
| 2018/0223500 | A1 | 8/2018 | Tsuchie et al. | |
| 2018/0230671 | A1 | 8/2018 | Wu | |
| 2020/0011029 | A1 | 1/2020 | Sano et al. | |
| 2020/0277753 | A1* | 9/2020 | Roh | E02F 9/264 |
| 2021/0012163 | A1 | 1/2021 | Li et al. | |
| 2021/0115643 | A1 | 4/2021 | Tanaka et al. | |

FOREIGN PATENT DOCUMENTS

| | | | |
|---|---|---|---|
| JP | 2017-53160 | A | 3/2017 |
| WO | WO 2017/033623 | A1 | 3/2017 |
| WO | WO 2017/047695 | A1 | 3/2017 |
| WO | WO 2018/174154 | A1 | 9/2018 |
| WO | WO 2019/189888 | A1 | 10/2019 |
| WO | WO 2020/049821 | A1 | 3/2020 |

OTHER PUBLICATIONS

Notice of Submission of Publication issued on Jan. 25, 2022 in Japanese Patent Application 2021-173020 filed on Dec. 24, 2021 (with English Translation) (10 pages).

Extended European Search Report issued Mar. 21, 2024 in European Patent Application No. 21889052.3, 5 pages.

* cited by examiner

FIG.12

Table1 Parameters of the proposed method

| | |
|---|---|
| Sampling time | $T_s$=0.01[sec] |
| Mean of gaussian white noisee | 0 |
| Variance of gaussian white noise | $\sigma^2=0.01^2$ |
| Number of Neighbors | k=3 |
| Initial number of data | $N_0$=108 |
| IMC filter | $\lambda$ =0.7<br>n=2 |
| Order of the weight function | $n_w$=2 |
| Database-driven filter | $\alpha$ =0.5 |
| Coefficient to inhibit the data | $\beta$ =0.0001 |
| Threshold of the attachment tip coordinate changing the soil parameters | $y_{2th1}$=−2.1<br>$y_{2th2}$=−2.3 |
| Fixed system parameters | $[a_1,a_2,b_0]$=<br>$[1.98,-0.985,5.66\times10^{-8}]$ |
| Soil Parameters for constructing database | $[\gamma_s[kg/m^3\times10^3],\phi_s[rad]]$=<br>[18,0.436],[18,0.611],[18,0.785],<br>[20,0.436],[20,0.611],[20,0.785],<br>[25,0.436],[25,0.611],[25,0.785],<br>[30,0.436],[30,0.611],[30,0.785] |

AUTONOMOUS DRIVING DEVICE FOR WORK MACHINE

TECHNICAL FIELD

The present invention relates to a technology of automatically operating a working machine.

BACKGROUND ART

Automatic operating devices each causing a hydraulic excavator to automatically perform a series of works from excavation to soil discharge have been recently known. For instance, Patent Literature 1 discloses a technology of: causing an automatic operating excavator to repeat a series of works from excavation to soil discharge by sequentially reading out taught positions having been taught and stored; and setting an engine rotational speed of the automatic operating excavator per specific work among the series of works.

In the automatic operation of the hydraulic excavator, a leading end of an attachment is required to move along a predetermined target locus on any worksite.

However, soil and sand to be excavated by the hydraulic excavator have different characteristics depending on a worksite. In this respect, the hydraulic excavator needs to generate an appropriate excavation force in consideration of the characteristics of soil and sand to move the leading end of the attachment along the target locus.

The technology of Patent Literature 1 without the consideration of the characteristics of soil and sand fails to allow the hydraulic excavator to generate an appropriate excavation force in accordance with the characteristics of the soil and sand.

The drawbacks are seen in other working machines as well as in the hydraulic excavator.

CITATION LIST

Patent Literature

Patent Literature 1: Japanese Unexamined Patent Publication No. 2001-32330

SUMMARY OF INVENTION

The present invention has been achieved to solve the drawbacks with an aim of providing an automatic operating device that permits a working machine to generate an appropriate force for causing a position of a portion of a working device that interacts with an object to meet a target position in consideration of an interaction between the working device and the object.

An automatic operating device according to one aspect of the present invention is an automatic operating device for a working machine including a working device having a portion to interact with an object. The automatic operating device includes: an acquisition part that acquires actual position data indicating an actual position of the portion; an estimation part that estimates estimative actual position data by inputting estimative force data to a first model defining a relation between force data indicating a force to occur on the portion and the actual position data by using a first parameter indicating characteristics of the interaction; a calculation part that calculates a deviation between: target position data indicating a target position of the portion; and a difference between the estimative actual position data and the actual position data; a computation part that computes estimative force data by inputting the deviation to a second model defining a relation between the deviation and force data for causing the actual position to meet the target position by using the first parameter; a setting part that calculates a second parameter corresponding to the estimative actual position data and the estimative force data on the basis of a first parameter having been calculated in past, and sets the first parameter on the basis of the second parameter; and an instructive value calculation part that calculates an instructive value to the working machine from the estimative force data.

This configuration enables the working machine to generate an appropriate force for causing a position of the portion of the working device that interacts with the object to meet the target position in consideration of characteristics of the interaction between the working device and the object.

BRIEF DESCRIPTION OF DRAWINGS

FIG. 12 is a table showing a value of each parameter used in establishment of an initial database.

DESCRIPTION OF EMBODIMENTS

Hereinafter, an embodiment of the present invention will be described with reference to the accompanying drawings. It should be noted that the following embodiment illustrates one specific example of the present invention, and does not delimit the protection scope of the present invention.

Figure 1:
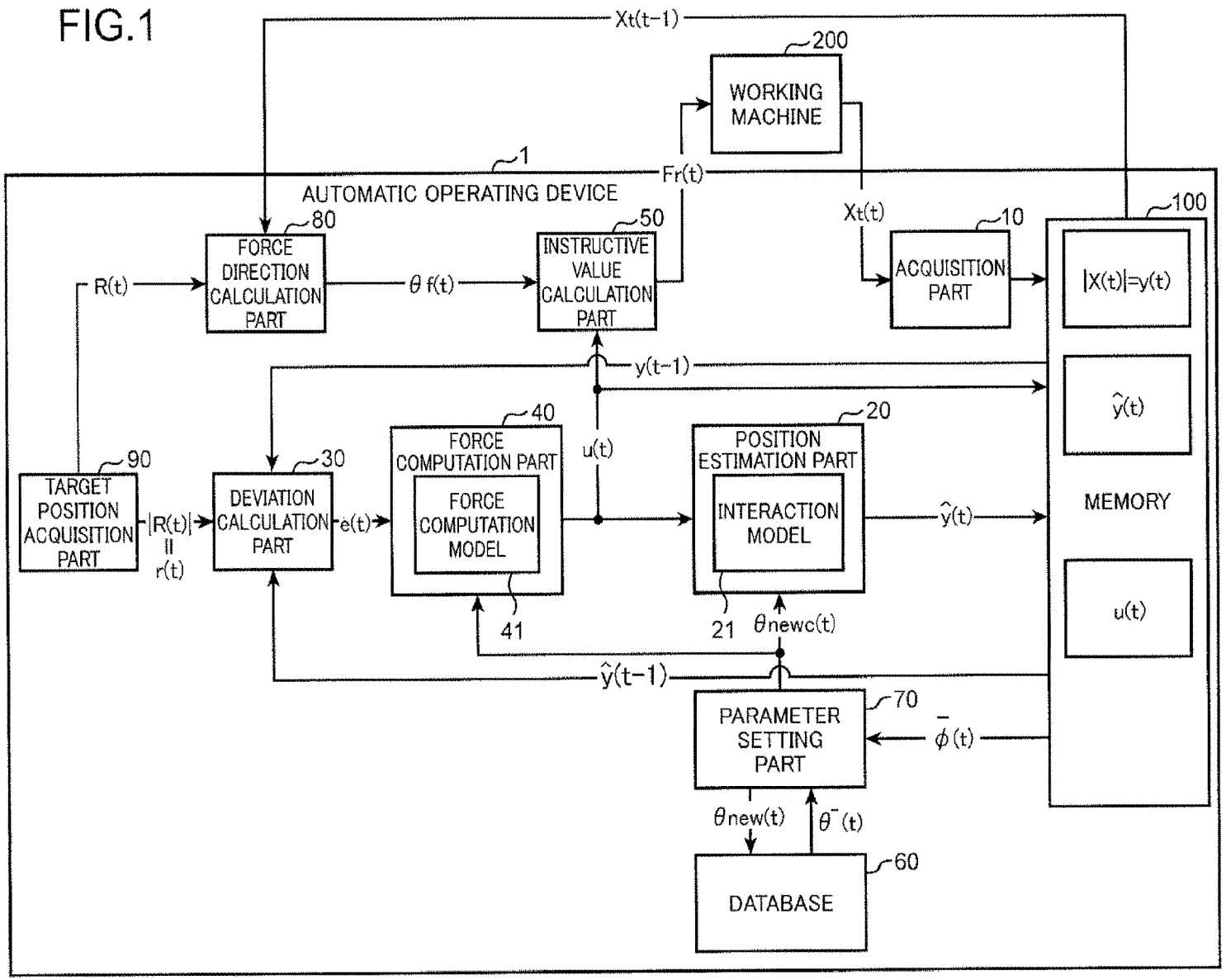
FIG. 1 is a block diagram showing an example of a configuration of an automatic operating device according to an embodiment of the present invention.

FIG. 1 is a block diagram showing an example of a configuration of an automatic operating device 1 according to an embodiment of the present invention. The automatic operating device 1 automatically operates a working machine 200. The working machine 200 includes a construction machine, such as a hydraulic excavator, a crane, or a dismantling machine. In the description below, the working machine 200 is described as a hydraulic excavator. However, this is a mere example, and the working machine 200 may be any working machine as long as the working machine includes a working device that interacts with an object.

The working machine 200 includes: a lower travelling body; an upper slewing body slewably attached to the lower travelling body; a boom tiltably attached to the upper slewing body; an arm swingably attached to the boom; and a bucket swingably attached to the arm. The boom, the arm, and the bucket constitute the working device. The working machine 200 further includes a hydraulic cylinder that raises and lowers the boom, a hydraulic cylinder that swings the arm, and a hydraulic cylinder that swings the bucket.

The automatic operating device 1 may be mounted on a controller already included in the working machine 200, or mounted on a computer having a communication device wirelessly communicable with the working machine 200.

The automatic operating device 1 includes an acquisition part 10, a position estimation part 20 (which is an example of the estimation part), a deviation calculation part 30 (which is an example of the calculation part), a force computation part 40 (which is an example of the computation part), an instructive value calculation part 50, a database 60, a parameter setting part 70 (which is an example of the setting part), a force direction calculation part 80, a target position acquisition part 90, and a memory 100.

The acquisition part 10 acquires, from the working machine 200, a coordinate $X_t(t)$ of an actual position of the distal end of the bucket. The working machine 200 further includes operability of detecting the coordinate of the distal end of the bucket on the basis of a slewing angle of the upper slewing body, an angle of the boom to the upper slewing body, an angle of the arm to the boom, and an angle of the bucket to the arm. Therefore, the acquisition part 10 may acquire, from the working machine 200, the coordinate of the distal end of the bucket detected with the operability as the coordinate $X_t(t)$ of the actual position.

The coordinate $X_t(t)$ of the actual position represents, for example, a coordinate on a two-dimensional plane perpendicularly intersecting a ground surface and defining the distal end of the bucket as an origin. Specifically, the coordinate $X_t(t)$ of the actual position is expressed by $X_t(t)=[x_t(t), y_t(t)]$. Here, the sign "t" denotes a time, and the sign "$x_t(t)$" denotes an x-axis component of the actual position in a two-dimensional plane coordinate system, and the sign "$y_t(t)$" denotes a y-axis component of the actual position in the two-dimensional plane system. For example, the x-axis is set in a longitudinal direction of the working device, and the y-axis is set in a direction perpendicularly intersecting the ground surface.

The distal end of the bucket is an example of a portion of the working device that interacts with an object. An origin of the two-dimensional plane coordinate system is set to, for example, a position where an interaction between the bucket and the object starts. The interaction between the bucket and the object indicates that the bucket and the object come into contact with each other, and give and take their respective forces. For instance, the working machine 200 detects, on the basis of a value of a cylinder pressure of the hydraulic cylinder, whether the interaction starts, and inputs a notification indicating a start of the interaction to the acquisition part 10. The working machine 200 further inputs a notification indicating a finish of the interaction to the acquisition part 10 in response to detection of the finish. In this manner, the acquisition part 10 can determine whether the working machine 200 is interacting with the object. The object includes, for example, soil and sand contained under the ground to be excavated by the bucket.

The acquisition part 10 calculates a norm $|X_t(t)|y(t)$ of an actual position from the acquired coordinate $X_t(t)$ of the actual position, and stores the coordinate $X_t(t)$ of the actual position and the norm y(t) of the actual position in the memory 100. Each of the coordinate $X_t(t)$ of the actual position and the norm y(t) of the actual position is an example of the actual position data.

The position estimation part 20 includes an interaction model 21 (which is an example of the first model). The interaction model 21 defines, by using a parameter indicating characteristics of the interaction between the working device and the object, a relation between a norm u(t) of a force to occur on the distal end of the bucket when the working device interacts with the object and the norm y(t) of the actual position of the distal end of the bucket. The norm u(t) of the force is an example of the force data.

The position estimation part 20 inputs the norm u(t) of the force computed by the force computation part 40 to the interaction model 21, and calculates, as a norm $\hat{y}$ (t) of an estimative position, a norm of y(t) of the actual position corresponding to the norm u(t) of the force. The position estimation part 20 stores the calculated norm $\hat{y}(t)$ of the estimative position in the memory 100. The norm $\hat{y}(t)$ of the estimative position is an example of the estimative actual position data. The interaction model 21 is expressed by Equation (6) to be described later.

As shown in Equation (6), the interaction model 21 indicates a function of the norm $\hat{y}(t)$ of the estimative position and the norm u(t) of the force. The parameters "$\hat{A}$" and "$\hat{B}$" on the left side are respectively expressed by Equation (7) and Equation (8). Equation (7) includes coefficients denoted by "$\hat{a}_1(t)$", "$\hat{a}_2(t)$", . . . Equation (8) includes coefficients denoted by "$\hat{b}_0(t)$", "$\hat{b}_1(t)$", . . . Each of the coefficients is a parameter (which is an example of the first parameter) of the interaction model 21. In the embodiment, a controlled target is modelized by Equation (26) as described later, and therefore, the interaction model 21 includes parameters "$\hat{a}_1(t)$", "$\hat{a}_2(t)$", and "$\hat{b}_0(t)$".

The parameters "$\hat{a}_1(t)$", "$\hat{a}_2(t)$", and "$\hat{b}_0(t)$" are respectively expressed by Equations (27) to (29) to be described later. As shown in Equations (27) to (29), each of "$\hat{a}_1(t)$", "$\hat{a}_2(t)$", and "$\hat{b}_0(t)$" includes "m(t)", "c(t)", and "k(t). The parameter "m(t)" indicates a mass, the parameter "k(t)" indicates a spring constant of a spring element, and the parameter "c(t)" indicates a viscosity coefficient of a damper element each about the interaction between the working device and the object, and these parameters directly indicate the characteristics of the interaction between the working device and the object.

Hence, the parameters "$\hat{a}_1(t)$", "$\hat{a}_2(t)$", and "$\hat{b}_0(t)$" indirectly indicate the characteristics of the interaction between the working device and the object, and thus, the interaction model 21 reflects the characteristics of the interaction.

The deviation calculation part 30 acquires the noun y(t−1) of the actual position and the norm $\hat{y}(t-1)$ of the estimative position from the memory 100, and calculates a difference by subtracting $\hat{y}(t-1)$ from y(t−1). The deviation calculation part 30 then calculates a deviation e(t) obtained by subtracting the calculated difference, from a norm |R(t)|(=r(t)) of the target position input from the target position acquisition part 90, and inputs the calculated deviation e(t) to the force computation part 40. Here, the reason why the deviation calculation part 30 acquires y(t−1), $\hat{y}(t-1)$ from the memory 100 lies in that y(t) and $\hat{y}(t)$ are not calculated at the calculation of the deviation e(t). The sign "t−1" represents a sample point that is one before "t".

The force computation part 40 includes a force computation model 41. The force computation model 41 defines, by using the same parameter as the parameter for the interaction model 21, a relation between the deviation e(t) and the norm u(t) of the force to occur on the distal end of the bucket for causing the actual position to meet the target position.

The force computation model is expressed by Equation (3) to be described later.

As shown in Equation (3), the force computation model 41 includes a function of the norm u(t) of the force and the deviation e(t). The parameter "$\hat{Q}$" on the right side is expressed by Equation (4) to be described later. As shown in Equation (4), the parameter "$\hat{Q}$" includes "$\hat{A}$" and "$\hat{B}$". As described above, the parameters "$\hat{A}$" and "$\hat{B}$" are expressed with the parameters "$\hat{a}_1(t)$", "$\hat{a}_2(t)$", and "$\hat{b}_0(t)$". It is seen from these perspectives that the force computation model 41 is defined by the same parameters as those for the interaction model 21.

The force computation part 40 inputs the deviation c(t) calculated by the deviation calculation part 30 to the force computation model 41, and computes a norm u(t) of a force corresponding to the deviation (e)t. The force computation part 40 inputs the computed noon u(t) of the force to each of the instructive value calculation part 50, the position estimation part 20, and the memory 100. The computed norm u(t) of the force is an example of the estimative force data.

The instructive value calculation part 50 calculates a force vector $F_r(t)$ on the basis of the norm u(t) of the force computed by the force computation part 40 and the direction θ(t) of the force calculated by the force direction calculation part 80. The instructive value calculation part 50 further inputs the force vector $F_r(t)$ as the instructive value to the working machine 200. Here, the instructive value calculation part 50 may calculate the force vector $F_r(t)$ by using Equation (31) to be described later.

The database 60 stores one or more base parameters θ(t) each being a parameter having been calculated by the parameter setting part 70 in past. Each base parameter θ(t) includes [$\hat{a}1(t)$, $\hat{a}_2(t)$, $\hat{b}_0(t)$].

The parameter setting part 70 calculates, on the basis of the base parameter $\overline{\theta}(t)$ stored in the database 60, a target parameter $\theta_{newc}(t)$ (which is an example of the second parameter) corresponding to a request point $\overline{\varphi}(t)$. The request point $\overline{\varphi}(t)$ is expressed by φ(t)=[y(t), y(t−1), y(t−2), u(t−1)]. Specifically, the request point $\overline{\varphi}(t)$ includes the nouns y(t), y(t−1), and y(t−2) of the actual position, and the norm u(t−1) of the force data. The request point $\overline{\varphi}(t)$ represents dynamics of a current interaction in the working machine 200 that reflect the current interaction between the working device and the object. The parameter setting part 70 further stores, as the base parameter $\overline{\theta}(t)$, an average parameter $\theta_{new}(t)$, which will be described later, obtained in the step of calculating the target parameter $\theta_{newc}(t)$ in the database 60.

The force direction calculation part 80 calculates a direction $\theta_f(t)$ of the force occurring on the distal end of the bucket on the basis of the coordinate R(t) of the target position input from the target position acquisition part 90 and a coordinate $X_t(t-1)$ of the actual position acquired from the memory 100. Here, the reason why the coordinate $X_t(t-1)$ of the actual position at a time "t−1" is acquired lies in that the coordinate $X_t(t)$ of the actual position is not calculated at this stage. The force direction calculation part 80 may calculate the direction $\theta_f(t)$ of the force by using Equation (30).

The target position acquisition part 90 acquires the coordinate R(t)=[$r_x(t)$, $r_y(t)$] of the target position, and inputs the coordinate to the force direction calculation part 80. The target position represents a position targeted by the distal end of the bucket. In the embodiment, the automatic operating device 1 automatically operates the working machine 200 to move the distal end of the bucket along a predetermined target locus. Hence, the target position is on the target locus. The target locus may be input by, for example, a manager.

The target position acquisition part 90 calculates a norm r(t) of the target position from the coordinate R(t) of the target position, and inputs the calculated norm to the deviation calculation part 30.

The memory 100 includes a RAM or a flush memory, and stores the coordinate $X_t(t)$ of the actual position, the norm y(t) of the actual position, and the norm $\hat{y}(t)$ of the estimative position. Here, the request point $\overline{\varphi}(t)$ includes norms y(t), y(t−1), and y(t−2) of the actual position until two previous sample points, and a no, u(t−1) of a force at one previous sample point, and therefore, the memory 100 may store at least the norms y(t), y(t−1), and y(t−2) of the actual position until the two previous sample points and at least the norm u(t−1) of the force at the one previous sample point. Besides, a norm $\hat{y}(t-1)$ of an estimative position of the one previous sample is used for calculation of a deviation e(t), and therefore, the memory 100 may store at least the norm $\hat{y}(t-1)$ of the estimative position at the one previous sample point.

In FIG. 1, each block, except for the memory 100, constituting the automatic operating device 1 is configured by, for example, a processor. The processor may include a CPU or a dedicated electric circuit, such as an ASIC.

Figure 2:
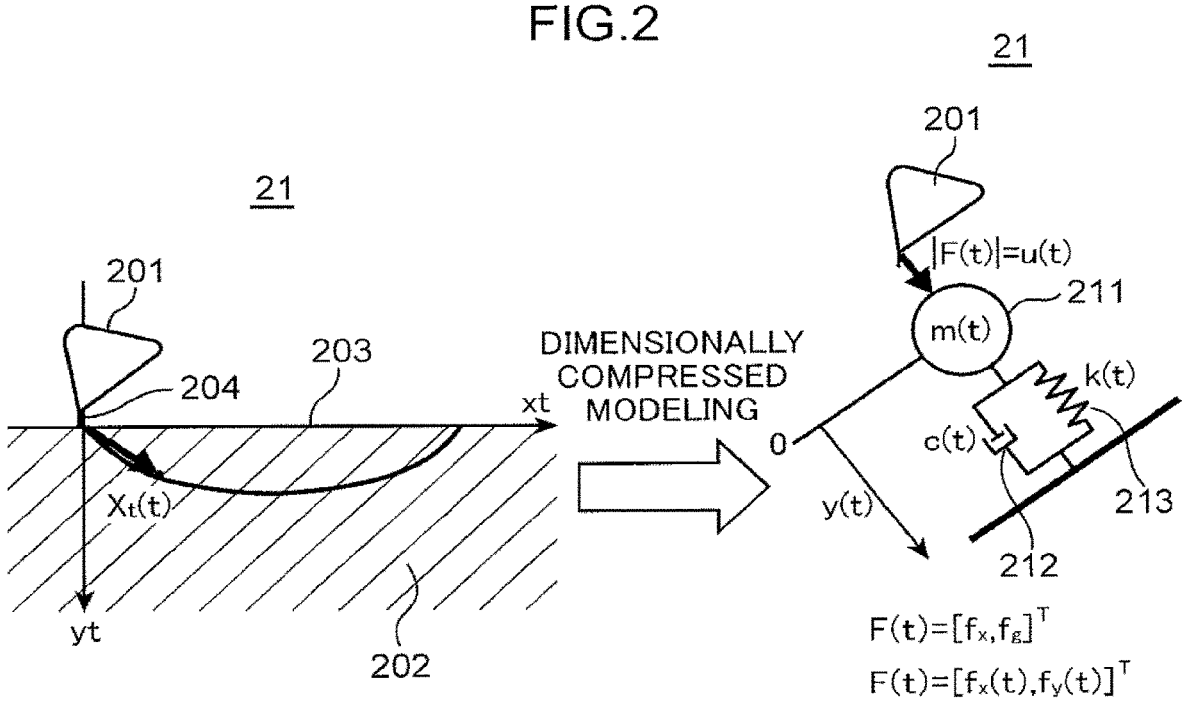
FIG. 2 is an explanatory view of an interaction model.

FIG. 2 is an explanatory view of the interaction model 21. As shown in the left section in FIG. 2, the interaction model 21 is established on the premise that the bucket 201 acts on a two-dimensional plane 202. The two-dimensional plane 202 extends in a longitudinal direction of the working device and perpendicularly intersects a ground surface 203. The two-dimensional plane 202 has an xt-axis set in the longitudinal direction of the working device and a yt-axis set in a direction perpendicularly intersecting the ground surface 203. The two-dimensional plane 202 further has an origin 204 set to a position where an interaction between the bucket 201 and the ground surface 203 starts.

As shown in the right section in FIG. 2, the interaction model 21 represents a spring mass damper model including a mass element 211, a damper element 212, a spring element 213 each about the interaction between the working device and the object. The mass element 211 is expressed with a mass m(t) of the interaction between the working device and the object. The damper element 212 is expressed with a viscosity coefficient c(t). The spring element 213 is expressed with a spring constant k(t). The damper element 212 and the spring element 213 are connected in parallel. The mass element 211 is connected in series to a parallel element unit having the damper element 212 and the spring element 213 connected in parallel. An equation of motion concerning the spring mass damper model is expressed by each of Equations (23) to (25) to be described later. The interaction model 21 is established by a model expressed by Equation (6) calculated on the basis of Equations (23) to (25).

As shown in the right section in FIG. 2, when the working device 2 acts on the two-dimensional plane 202, each of the force F(t) occurring the distal end of the bucket 201 and the coordinate $X_t(t)$ of the actual position of the distal end of the bucket is two-dimensionally shown. In this respect, the interaction model 21 is expressed by a norm |F(t)| of F(t), and a norm $|X_t(t)|$(=y(t)) of an estimative position. Specifically, the interaction model 21 is formed of a dimensionally compressed model having input and output variables which are dimensionally compressed. The interaction model 21 in the form of the dimensionally compressed model aims at simplification of the interaction model 21.

Figure 3:
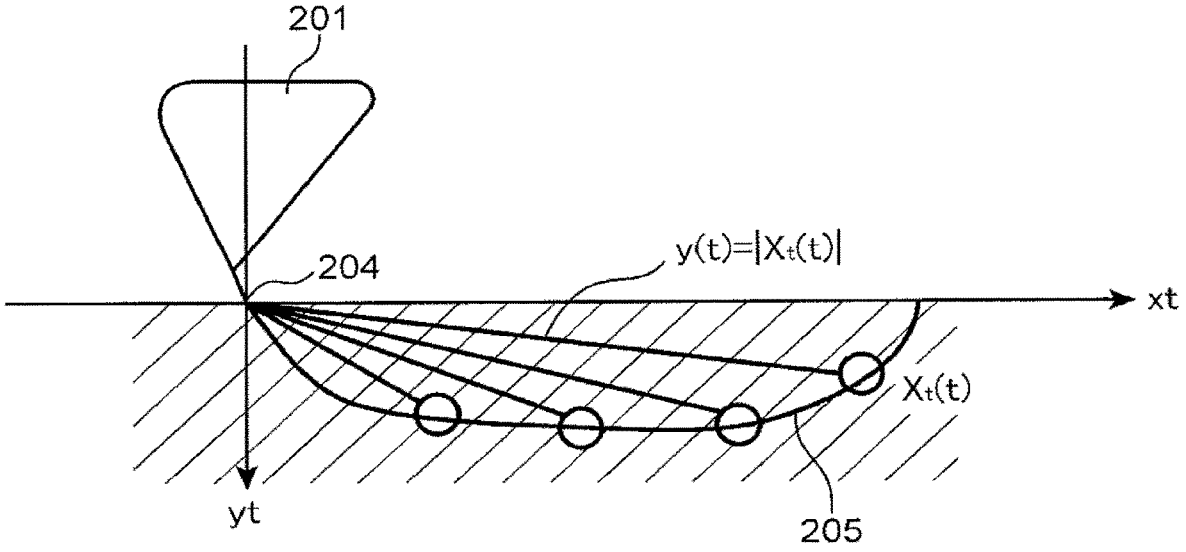
FIG. 3 is a diagram showing a change in a norm of an actual position during excavation.

FIG. 3 is a diagram showing a change in the norm y(t) of the actual position during excavation. In the example shown in FIG. 3, the distal end of the bucket comes into contact with the ground surface 203 at the origin 204, and thereafter, the distal end of the bucket moves along a locus 205. The norm y(t) of the actual position indicates a distance between the origin 204 and the actual position. Hence, the norm y(t) of the actual position increases as the excavation progresses.

The interaction model 21 is dimensionally compressed as described above, and thus, the direction $\theta_f(t)$ of the force may be instructed to the working machine 200 in addition to the norm u(t) of the force to operate the working machine 200. The force direction calculation part 80 therefore calculates the direction $\theta_f(t)$ of the force.

Figure 4:
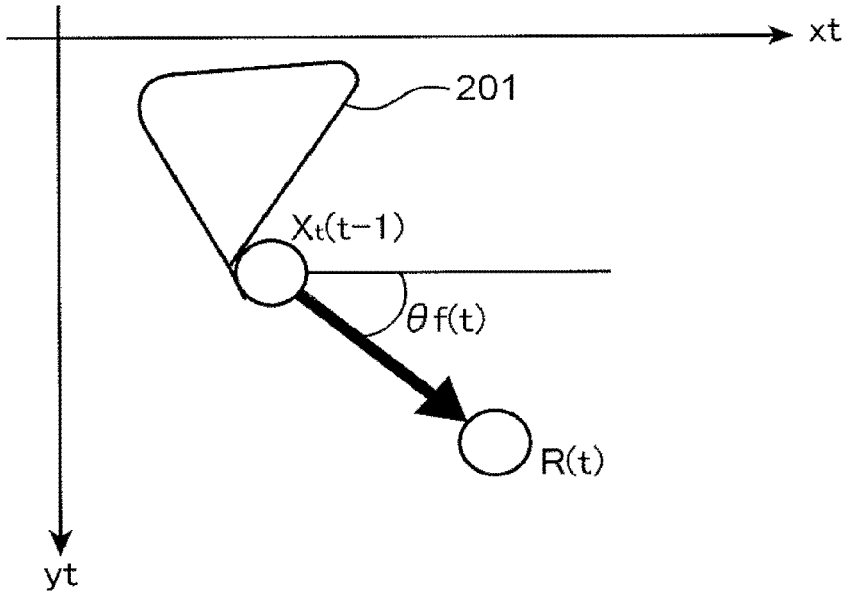
FIG. 4 is an explanatory view of a force direction.

FIG. 4 is an explanatory view of the direction $\theta_f(t)$ of the force. The force computation part 40 computes a norm u(t) of the force for causing the actual position to meet the target position as described above. Therefore, when a coordinate of an actual position at a time t−1 is defined as $X_t(t-1)$, a direction $\theta_f(t)$ of a force at a time t is oriented to the coordinate R(t) of the target position from the coordinate $X_f(t-1)$ of the actual position. Here, the force direction calculation part 80 calculates the direction $\theta_f(t)$ of the force by using the coordinate $X_t(t-1)$ of the actual position and the coordinate R(t) of the target position.

Figure 5:
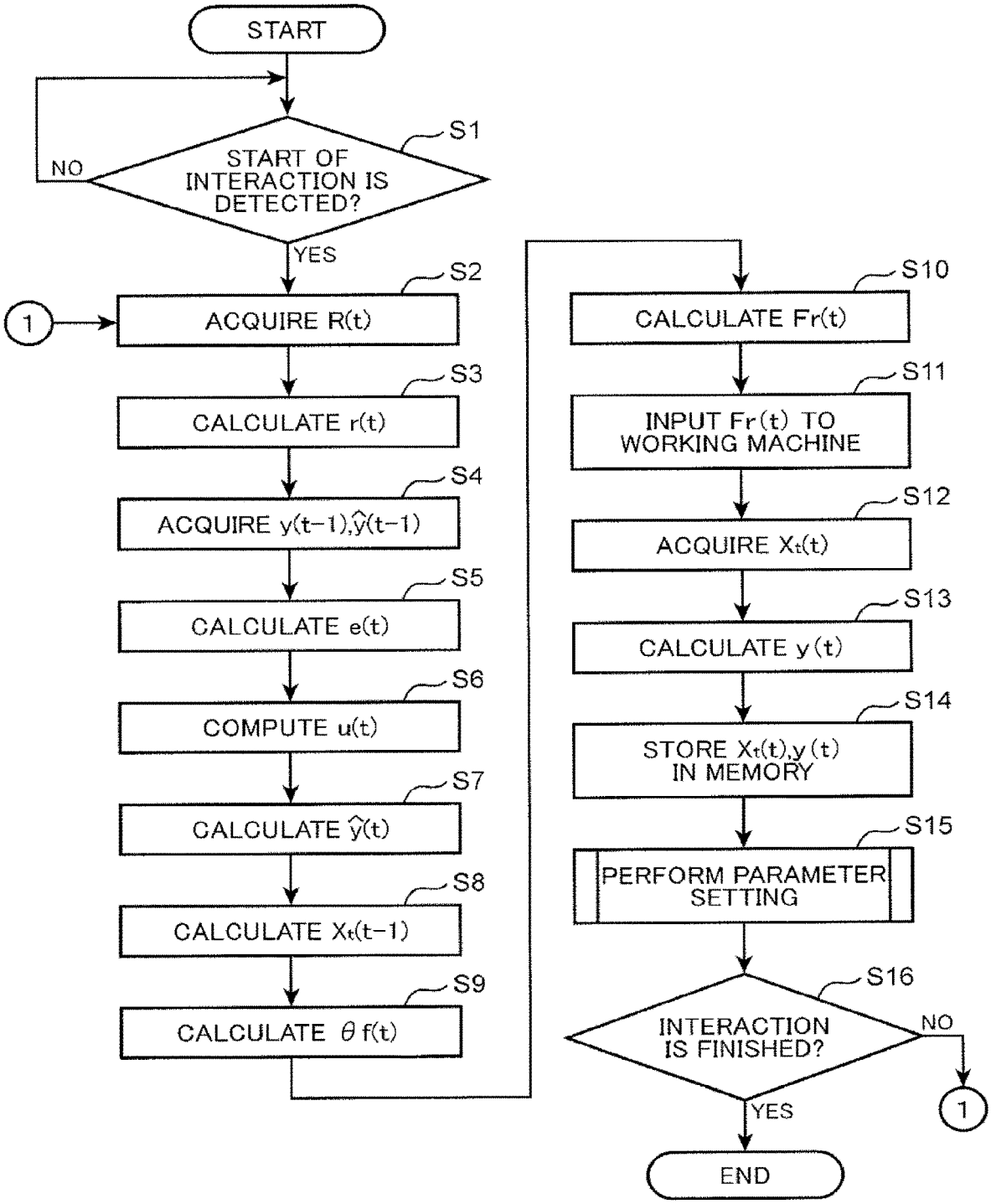
FIG. 5 is a flowchart showing an example of a process by the automatic operating device shown in FIG. 1

FIG. 5 is a flowchart showing an example of a process by the automatic operating device 1 shown in FIG. 1. In step S1, the acquisition part 10 detects a start of an interaction between the working device and an object. Here, the acquisition part 10 may determine that the interaction occurs when receiving a notification about the start of the interaction from the working machine 200.

The flow proceeds to step S2 when the start of the interaction is detected (YES in step S1), and the flow waits in step S1 on standby when the start of the interaction is not detected (NO in step S1).

In step S2, the target position acquisition part 90 acquires a coordinate R(t) of a target position. For instance, the target position acquisition part 90 may sequentially acquire points on a target locus stored in the memory 100 each as the coordinate R(t) of the target position.

In step S3, the target position acquisition part 90 calculates a norm r(t) of the target position from the coordinate R(t) of the target position. The norm r(t) of the target position represents a distance from an origin to the target position, the origin being a start position of an interaction.

In step S4, the deviation calculation part 30 acquires a norm y(t−1) of an actual position and a norm $\hat{y}(t-1)$ of an estimative position from the memory 100.

In step S5, the deviation calculation part 30 calculates a deviation e(t) by using the norm r(t) of the target position, the norm y(t−1) of the actual position, and the norm $\hat{y}(t-1)$ of the estimative position as described above.

In step Sb, the force computation part 40 inputs the deviation e(t) to the force computation model 41, and computes a norm u(t) of a force. At this time, the force computation part 40 computes the u(t) by using a parameter initial value or a parameter $\theta_{new}(t)$ determined in a previous step.

In step S7, the position estimation part 20 inputs the norm u(t) of the force to the interaction model 21, and calculates a norm $\hat{y}(t)$ of an estimative position.

In step S8, the force direction calculation part 80 acquires a coordinate $X_t(t-1)$ of the actual position from the memory 100.

In step S9, the force direction calculation part 80 calculates a direction $\theta_f(t)$ of the force by substituting the coordinate R(t) of the target position and the coordinate $X_f(t-1)$ of the actual position for Equation (30).

In step S10, the instructive value calculation part 50 calculates a force vector $F_r(t)$ by substituting the norm u(t) of the force and the direction $\theta_f(t)$ of the force for Equation (31).

In step S11, the instructive value calculation part 50 inputs, as an instructive value, the force vector $F_r(t)$ to the working machine 200.

In step S12, the acquisition part 10 acquires, from the working machine 200, the coordinate $X_t(t)$ of the actual position calculated by the working machine 200 in response to the input of the instructive value.

In step S13, the acquisition part 10 calculates a norm y(t) of the actual position from the coordinate $X_t(t)$ of the actual position.

In step S14, the acquisition part 10 stores the coordinate $X_1(t)$ and the norm y(t) of the actual position in the memory 100.

In step S15, the parameter setting part 70 executes a parameter setting. The parameter setting will be described in detail later.

In step S16, the acquisition part 10 determines whether the interaction finishes. Here, the acquisition part 10 may determine that the interaction finishes when receiving a notification about the finish of the interaction from the working machine 200. The finish of the interaction indicates a state where the distal end of the bucket and the object are in no contact with each other. The flow finishes when it is determined that the interaction finishes (YES in step S16), and the flow returns to step S2 when it is determined that the interaction is not finished (NO in step S16).

In this way, in the flowchart shown in FIG. 5, steps by the automatic operating device 1 are sequentially executed during the occurrence of the interaction.

Figure 6:
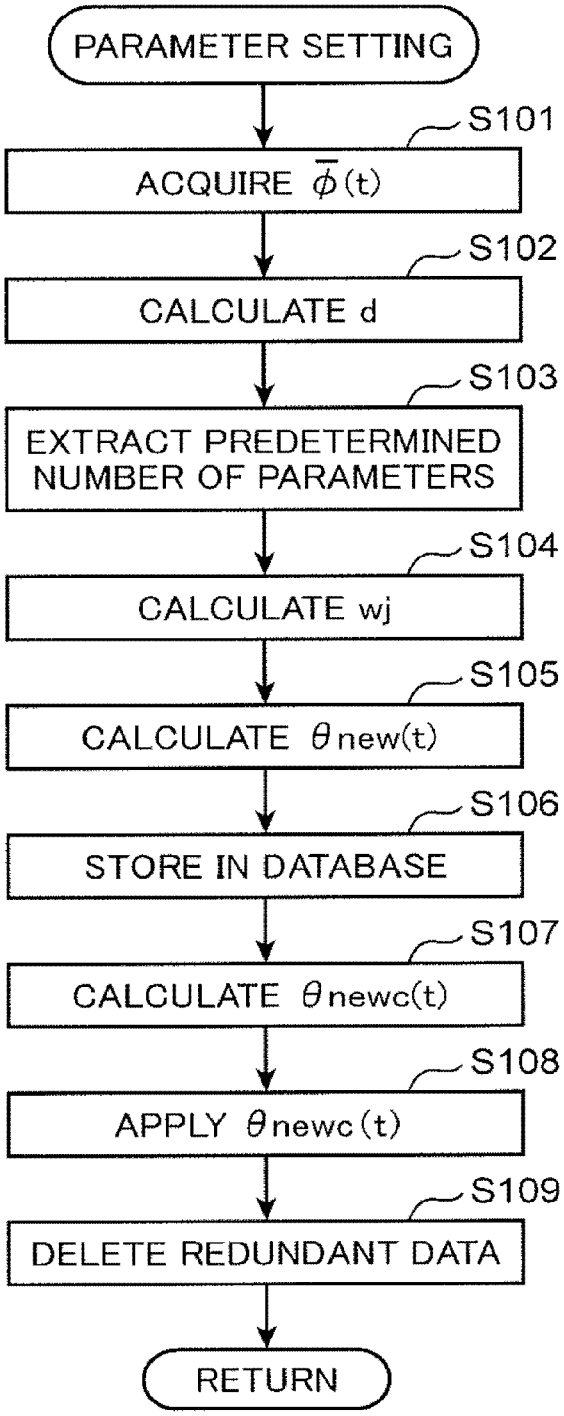
FIG. 6 is a flowchart showing a parameter setting in detail.

FIG. 6 is a flowchart showing a parameter setting in detail. In step S101, the parameter setting part 70 acquires a request point (WO from the memory 100.

In step S102, the parameter setting part 70 calculates a distanced between a request point $\overline{\varphi}(t)$ and a base parameter $\overline{\theta}(t)$ by using Equation (18) to be described later (step S102).

In step S103, the parameter setting part 70 extracts k-base parameters in ascending order of distances d from among base parameters $\overline{\theta}(t)$ stored in the database 60.

In step S104, the parameter setting part 70 calculates a weight $w_j$ of each of the k-base parameters extracted by using Equation (19).

In step 105, the parameter setting part 70 calculates an average parameter $\theta_{new}(t)$ being an average value of weights of the extracted k-base parameters by using Equation (20).

In step S106, the parameter setting part 70 stores, as the base parameter $\overline{\theta}(t)$, the average parameter $\theta_{new}(t)$ in the database 60.

In step S107, the parameter setting part 70 modifies the average parameter $\theta_{new}(t)$ by using Equation (21), and calculates a target parameter $\theta_{newc}(t)$. The modification is made to prevent deterioration of control performance attributed to an abrupt change in the average parameter $\theta_{new}(t)$.

In step S108, the parameter setting part 70 sets the target parameter $\theta_{newc}(t)$ to a parameter of each of the interaction model 21 and to a parameter of the force computation model 41. In this manner, an appropriate parameter is set to each of the interaction model 21 and the force computation model 41 in accordance with a current interaction.

In step S109, the parameter setting part 70 extracts, as redundant data, a base parameter $\overline{\theta}(t)$ having a distance di of a predetermined value β or smaller to the average parameter $\theta_{new}(t)$ from among base parameters OW stored in the database 60, and deletes the redundant data from the database 60. The distance di is expressed by Equation (22) to be described later. When step S109 is finished, the flow proceeds to step S16 in FIG. 5.

Figure 7:
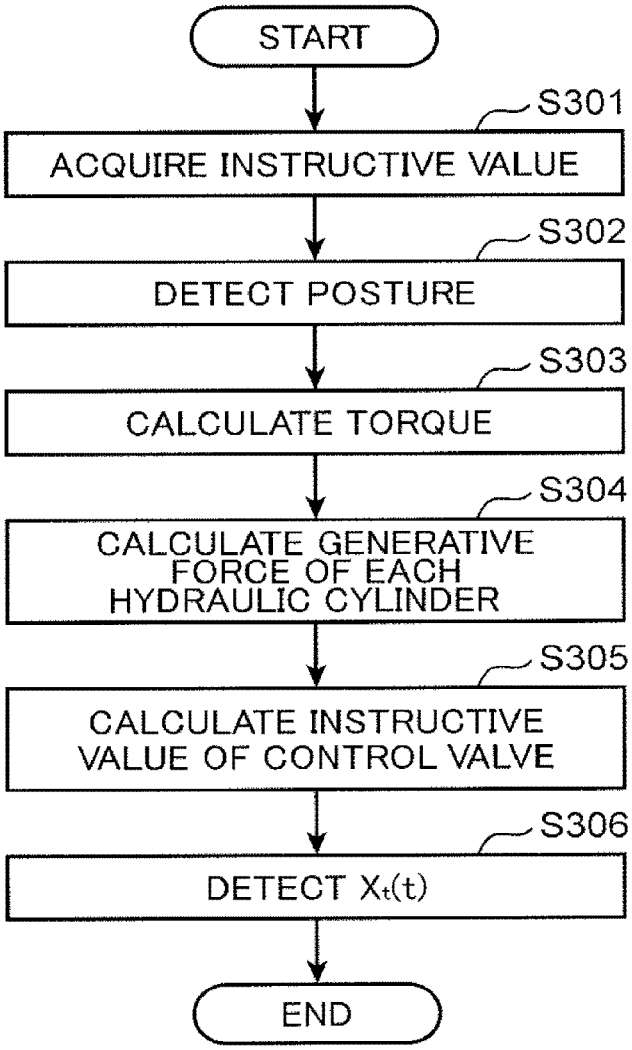
FIG. 7 is a flowchart showing an example of a process by a working machine in response to an instructive value input from the automatic operating device.

FIG. 7 is a flowchart showing an example of a process by the working machine 200 in response to an instructive value input from the automatic operating device 1. In step S301, a controller included in the working machine 200 acquires the instructive value from the automatic operating device 1. The instructive value includes a force vector $F_r(t)$ calculated by the instructive value calculation part 50.

In step S302, the controller of the working machine 200 detects a posture of the working device. Here, the controller of the working machine 200 detects, as the posture of the working device, an angle of the boom, and angle of the arm, and an angle of the bucket, each angle being detected by an angle sensor.

In step S303, the controller of the working machine 200 calculates, on the basis of the posture of the working device and various specification data of the working device, torques respectively generated in the boom, the arm, and the bucket. The various specification data includes, for example, a mass and a length of each of the boom, the arm, and the bucket.

In step S304, the controller of the working machine 200 calculates a generative force of the hydraulic cylinder of each of the boom, the arm, and the bucket from the torque generated in each of the boom, the arm, and the bucket.

In step S305, the controller of the working machine 200 calculates an instructive value to a control valve of each of the boom, the arm, and the bucket from the generative force of each of the boom, the arm, and the bucket.

In step S306, the controller of the working machine 200 detects a coordinate $X_t(t)$ of the actual position of the distal end of the bucket. The detected coordinate $X_t(t)$ is input to the automatic operating device 1.

As described heretofore, the automatic operating device 1 according to the embodiment calculates, on the basis of a base parameter $\overline{\theta}(t)$ having been calculated in past, a target parameter $\theta_{newc}(t)$ corresponding to a norm u(t−1) of a force computed by using the force computation model 41 and corresponding to each of norms y(t), y(t−1), and y(t−2) of the actual position acquired by the acquisition part 10, and sets the target parameter $\theta_{newc}(t)$ to a parameter of each of the interaction model 21 and the force computation model 41. Then, a norm u(t) of a force for causing the distal end of the bucket to reach the target position by using the force computation model 41 having the setting of the target parameter $\theta_{newc}(t)$ is computed, an instructive value is calculated on the basis of the computed norm u(t) of the force, and the calculated instructive value is input to the working device. Here, a relation between the norm y(t) of the actual position and the norm u(t) of the force includes characteristics of the interaction. Thus, the target parameter corresponding to each of the norm y(t) of the actual position and the norm u(t) of the force reflects the characteristics of the interaction. In this manner, the parameter reflecting the characteristics of the interaction is settable for each of the interaction model 21 and the force computation model 41. This results in enabling the working machine to generate an appropriate force for causing a position of an interactive portion to meet the target position in consideration of the characteristics of the interaction.

The embodiment can adopt modifications described below.

(1) Each of an output variable of the force computation model 41 and an input variable of the interaction model 21 is not limited to the norm u(t) of the force, and may be a two-dimensional vector or a three-dimensional vector each indicating the force. In this case, the force direction calculation part 80 is excludable, and the instructive value calculation part 50 may input, as an instructive value, the two-dimensional vector or the three-dimensional vector each indicating the force to the working machine 200.

(2) An output variable of the interaction model 21 is not limited to the norm y(t) of the estimative position, but may be a two-dimensional coordinate or a three-dimensional coordinate of the estimative position.

(3) The interaction model 21 is established on the premise that the bucket 201 acts on the two-dimensional plane 202, but may be established on the premise that the bucket 201 acts on a three-dimensional plane. In this case, the interaction model 21 is established in consideration of slewing of the upper slewing body in addition to the operation of the working device.

(4) The interaction model 21 represents the spring mass damper model, but may represent any model as long as the model shows a relation between force data and estimative position data.

(5) Although the interaction model 21 includes the damper element 212 and the spring element 213, any one of the elements may be excluded.

(6) The database 60 may store the target parameter $\theta_{newc}(t)$ in place of the average parameter $\theta_{new}(t)$. The database 60 may further store, as parameters, a mass (mt), a spring constant k(t), and a viscosity coefficient c(t) each about an interaction between the working device and an object. In this case, the parameter setting part 70 may convert the mass m(t), the spring constant k(t), and the viscosity coefficient c(t) respectively to parameters $\hat{a}_1(t)$, $\hat{a}_2(t)$, and $\hat{b}_0(t)$ by using Equations (27) to (29) to be described later. Then, the parameter setting part 70 may calculate a target parameter $\theta_{newc}(t)$ by using the converted parameters $\hat{a}_1(t)$, $\hat{a}_2(t)$, and $\hat{b}_0(t)$.

(7) The parameter setting part 70 may set, in place of the target parameter $\theta_{newc}(t)$, an average parameter $\theta_{new}(t)$ to a parameter of each of the interaction model 21 and the force computation model 41. In this case, the average parameter $\theta_{new}(t)$ serves as an example of the target parameter.

(8) In a case where the working machine 200 is in the form of a dismantling machine including a demolisher in place of the bucket, adoptable force data may be data indicating a gripping force of gripping an object by the demolisher of the dismantling machine.

(9) Although the distal end of the bucket is adopted as an interactive portion, another portion of the bucket (e.g., a gravity center or a center of the bucket) except for the distal end of the bucket may be adopted as the interactive portion.

(10) The working machine 200 shown in FIG. 1 may be a digital twin of a working machine reproduced in a cyberspace or virtual space in place of a real working machine.

EXAMPLE

Figure 8:
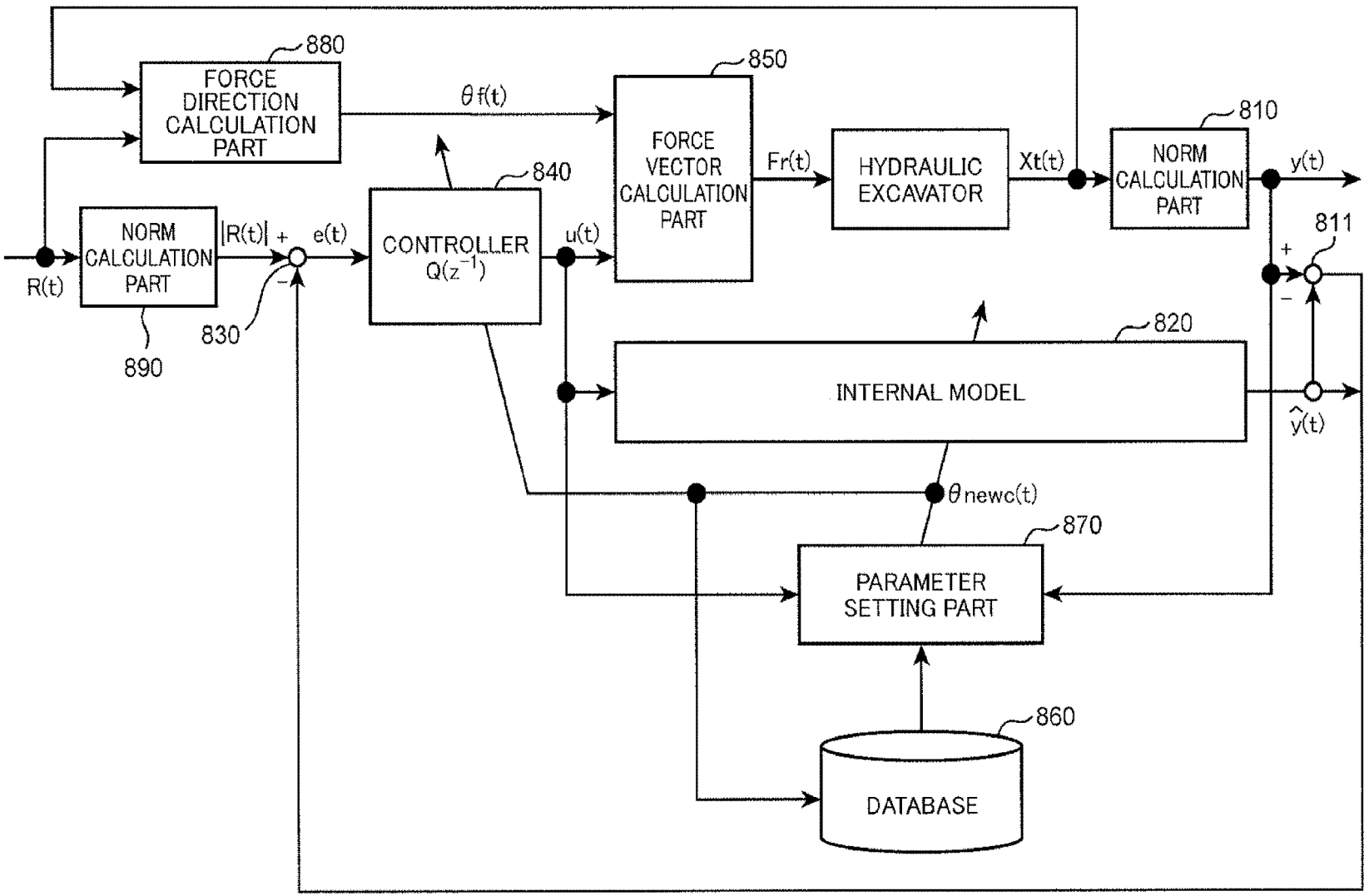
FIG. 8 is a block diagram showing a configuration of an automatic operating device according to Example.

Next, Example of the present invention will be described. FIG. 8 is a block diagram showing a configuration of an automatic operating device according to Example. The automatic operating device includes an internal model control system based on a database drive-type approach. In Example, a mathematical model of a hydraulic excavator is adopted as the working machine 200. The mathematical model is expressed by Equation (32) to be described later.

The automatic operating device according to Example includes a norm calculation part 810, a subtraction part 811, an internal model 820, a subtraction part 830, a controller 840, a force vector calculation part 850, a database 860, a parameter setting part 870, a force direction calculation part 880, and a norm calculation part 890.

In FIG. 8, blocks given the same names as those of the blocks in FIG. 1 work in the same manner as in FIG. 1, and thus description for the blocks will be omitted. The internal model 820 corresponds to the interaction model 21. The controller 840 corresponds to the force computation model 41.

The norm calculation part 810 corresponds to the acquisition part 10 in FIG. 1 and calculates a norm of a coordinate $X_t(t)$ of an actual position. The subtraction part 811 and the subtraction part 830 correspond to the deviation calculation part 30 in FIG. 1. The subtraction part 811 calculates a difference by subtracting a norm $\hat{y}(t)$ of an estimative position from a norm y(t) of an actual position. The subtraction part 830 calculates a deviation e(t) by subtracting the difference from a norm |R(t)| of a target position. The norm calculation part 890 calculates the norm |R(t)| of the target position from the coordinate R(t) of the target position.

A controlled target in Example is considered as a discrete time nonlinear system expressed by Equation (1).

Formula 1

$$y(t)=h(\varphi(t-1)) \tag{1}$$

The sign "y(t)" denotes an output of the discrete time nonlinear system, the sign h(·) denotes a non-linear function, and the sign "φ(t−1)" denotes an information vector. The information vector φ(t−1) is defined by the following formula.

Formula 2

$$\varphi(t-1):=[y(t-1), \ldots, y(t-n_y), u(t-1), \ldots, u(t-n_u-1)] \tag{2}$$

The sign "u(t)" denotes an input, and the signs "$n_y$" and "$n_u$" respectively represent an order of an output (y(t)) and an order of an input (u(t)).

The internal model control system shown in FIG. 1 is expressible by the following formula.

Formula 3

$$u(t) = \hat{Q}(z^{-1}, t)e(t) \tag{3}$$

$$\hat{Q}(z^{-1}, t) = \left(\frac{1-\lambda}{1-\lambda z^{-1}}\right)^n \frac{\hat{A}(z^{-1}, t)}{\hat{B}(z^{-1}, t)} \tag{4}$$

$$e(t) : +r(t) - \{y(t) - \hat{y}(t)\} \tag{5}$$

$$\hat{A}(z^{-1}, t)\hat{y}(t) = \hat{B}(z^{-1}, t)u(t-1) \tag{6}$$

The sign "r(t)" denotes a controlled target value, the sign "$\hat{y}$(t)" denotes a norm of an estimative position output from the internal model 820, the sign "λ" denotes a design parameter of a filter, and the sign "n" denotes an order of the filter. Further, each of "$\hat{A}(z^{-1}, t)$" and "$\hat{B}(z^{-1}, t)$" includes a polynomial indicating the discrete time nonlinear system as described below. Each of "$\hat{A}(z^{-1}, t)$" and "$\hat{B}(z^{-1}, t)$" is locally and stably presumed as a minimum phase system.

Formula 4

$$\hat{A}(z^{-1},t)=1+\hat{a}_1(t)z^{-1}+\ldots+\hat{a}_{n_y}(t)z^{-n_y} \tag{7}$$

$$\hat{B}(z^{-1},t)=\hat{b}_0(t)+\hat{b}_1(t)z^{-1}+\ldots+\hat{b}_{n_u}(t)z^{-n_u} \tag{8}$$

A controlled target expressed by Equation (1) is locally describable by the following formula.

Formula 5

$$\hat{A}(z^{-1},t)y(t)=\hat{B}(z^{-1},t)u(t-1) \tag{9}$$

At this time, Equation (9) is described as follows by using Equation (26) medializing the controlled target.

Formula 6

$$y(t)=\theta(t)\phi(t-1)^T \tag{10}$$

$$\theta(t):=[\hat{a}_1(t),\hat{a}_2(t),\hat{b}_0(t)] \tag{11}$$

$$\phi(t-1):=[y(t-1),y(t-2),u(t-1)] \tag{12}$$

The parameter θ(t) is described as follows by Equation (10). The parameter θ(t) represents a parameter of the discrete time nonlinear system.

Formula 7

$$\theta(t)=f(\overline{\varphi}(t)) \tag{13}$$

$$\overline{\varphi}(t):=[y(t),y(t-1),y(t-2),u(t-1)] \tag{14}$$

Here, the parameter "f(·)" denotes a linear function. A request point $\overline{\varphi}$(t) and a base parameter $\overline{\theta}$(j) stored in the database 860 are defined in the following manner to locally calculate the parameter θ(t) at each time.

Formula 8

$$\overline{\varphi}(t):=[y(t),y(t-1),y(t-2),u(t-1)] \tag{15}$$

$$\overline{\theta}(j)=[\hat{a}_1(j),\hat{a}_2(j),\hat{b}_0(j)] \tag{16}$$

The parameter "$\overline{\theta}$(j)" will be described in detail later.

Adjustment of the parameter of each of the controller 840 and the internal model 820 based on the database drive-type approach will be described below.

Step #1: Establishment of Initial Database

The parameter setting part 870 obtains a parameter about Equation (26) by recursive least squares using input and output data of a controlled target. The parameter setting part 870 defines the obtained parameter as a base parameter $\overline{\theta}$(j). The parameter setting part 870 stores the base parameter $\overline{\theta}$(j) in an initial database $\overline{\Theta}$(j) defined by the following formula.

Formula 9

$$\overline{\Theta}(j):=[\overline{\theta}(j)] \tag{17}$$

$$j=1,2,\ldots N_0$$

The sign "No" denotes the number of base parameters.

Step #2: Calculation of System Parameter

The parameter setting part 870 calculates a distance between the request point $\overline{\varphi}$(t) and each base parameter $\overline{\theta}$(j) by the following formula. The parameter setting part 870 rearranges the base parameters $\overline{\theta}(j)$ in ascending order of distances.

Formula 10

$$d(\overline{\phi}(t), \overline{\theta}(j)) = \frac{\left|\sum_{i=1}^{3} \overline{\theta}_i(j) + \overline{\phi}_{i+1}(t) - y(t)\right|}{\sqrt{\sum_{i=1}^{3} \overline{\theta}_i(j)^2 + 1}} \quad (18)$$

$$j = 1, 2, \ldots, N(t)$$

Here, the sign "N(t)" denotes the number of base parameters stored in the database 860 when the request point $\overline{\varphi}(t)$ is given. The sign "i" denotes an i-th element of each of the request point and the base parameter. Equation (18) expresses a distance between the base parameter $\overline{\theta}(j)$, hyperplane obtained by Equation (9), and the request point $\overline{\varphi}(t)$. The parameter setting part 870 extracts k-base parameters in ascending order of $d(\overline{\varphi}(t), \overline{\theta}(j))$, and calculates the weight $w_j$ of each base parameter by the following formula.

Formula 11

$$w_j = \frac{d(\overline{\phi}(t), \overline{\theta}(j))^{-n_w}}{\sum_{l=1}^{k} d(\overline{\phi}(t), \overline{\theta}(l))^{-n_w}}, \quad \sum_{i=1}^{k} w_i = 1 \quad (19)$$

$$j = 1, 2, \ldots, N(t)$$

Here, the sign "$n_w$" denotes a design parameter for distinguishing a difference in the weight corresponding to the distance. Moreover, the parameter setting part 870 calculates an average parameter $\theta_{new}(t)$ of the k-base parameters $\overline{\theta}(t)$ by a local linear average way shown in the following formula, and stores the calculated average parameter in the database 860 as the base parameter $\overline{\theta}(t)$.

Formula 12

$$\theta_{new}(t) = \sum_{i=1}^{k} w_i \overline{\theta}(i) \quad (20)$$

Step #3: Preprocess Before Input Determination

The parameter setting part 870 modifies the average parameter $\theta_{new}(t)$ by using a first-order log filter expressed by the following formula to prevent deterioration of the control perfomance attributed to an abrupt change in the average parameter $\theta_{new}(t)$ obtained in Step #2.

Formula 13

$$\theta_{new_c}(t) = \frac{1-\alpha}{1-\alpha z^{-1}} \theta_{new}(t) \quad (21)$$

The sign "α" denotes a design parameter of the filter and is determined in trial and error. The parameter setting part 870 defies the average parameter $\theta_{new}(t)$ modified by Equation (21) as a target parameter $\theta_{newc}(t)$. The, the parameter setting part 870 applies the target parameter $\theta_{newc}(t)$ to each of the controller 840 expressed by Equation (3) and the internal model 820 expressed by Equation (6).

Step #4: Deletion of Redundant Data

Deletion of redundant data in the database 860 is desired in consideration of a memory capacity and a calculation cost of an object to be mounted. The parameter setting part 870 deletes a base parameter satisfying the following condition from among the base parameters.

Formula 14

$$d_j(\overline{\theta}(j), \theta_{new}(t)) = \sum_{i=1}^{3} \left|\overline{\theta}_i(j) - \theta_{new,i}(t)\right| \le \beta \quad (22)$$

The sign "β" denotes a design parameter for selecting abase parameter to be deleted, and is determined in trial and error.

The parameter setting part 870 deletes only a nearest neighbor base parameter when a plurality of base parameters satisfies the condition of Equation (22).

Execution of steps from Step #2 to Step #4 at each time achieves online calculation of a target parameter $\theta_{newc}(t)$ reflecting a current interaction. The parameter setting part 870 applies a target parameter $\theta_{newc}(t)$ calculated one after another to each of the controller 840 and the internal model 820.

Subsequently, an interaction model of a hydraulic excavator will be described.

Figure 9:
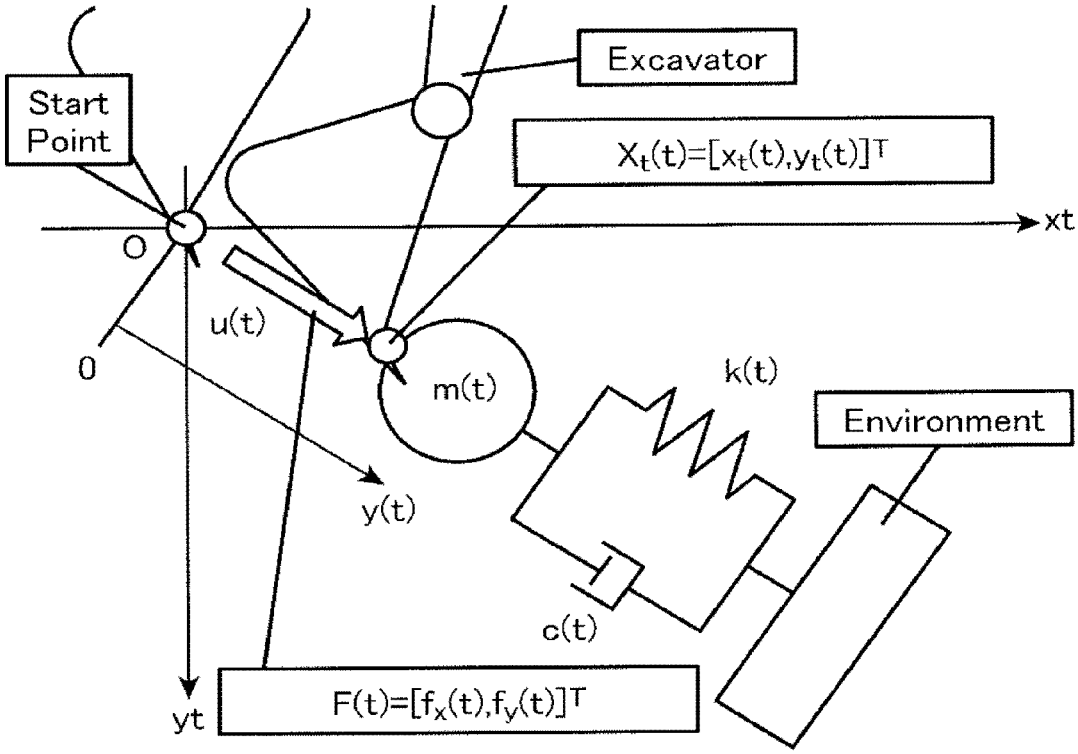
FIG. 9 illustrates a controlled target in Example.

The interaction model is intended for controlling, as a controlled target, an interaction between a leading end of an attachment (a working device including a bucket) of the hydraulic excavator and an environment (an object). The hydraulic excavator comes into operation in accordance with a combination of an operation of the attachment and a slewing action of a main body in combination. However, in Example, the interaction model is established with limitation to only the operation of the attachment. The interaction between the attachment and the environment is presumed to be a resistance to locally occur due to a mass element, a spring element, and a damper element. The controlled target is expressible with a model shown in FIG. 9. An equation of motion of the model is expressed as follows.

Formula 15

$$m(t)\frac{d^2 y(t)}{dt^2} + c(t)\frac{dy(t)}{dt} + k(t)y(t) = u(t) \quad (23)$$

$$y(t) = |X_t(t)| \quad (24)$$

$$u(t) = |F(t)| \quad (25)$$

The equation "$X_t(t)=[x_t(t), y_t(t)]^T$" shows a position of the leading end of the attachment. The equation "$F(t)=[f_x(t), f_y(t)]^T$ shows a force vector of the leading end of the attachment. The sign "m(t)" denotes a mass of an interaction between the working device and the object. The sign "k(t)" denotes a spring constant. The sign "c(t)" denotes a viscosity coefficient.

Characteristics of the interaction between the leading end of the attachment of the hydraulic excavator and the environment change depending on an operation condition and an environmental condition. In this respect, in Example, the change is represented by a change in each of the mass m(t), the spring constant k(t), and the viscosity coefficient c(t) about the interaction between the working device and the object, each being a parameter of the model. When Equation (23) is discretized by a difference method, a discrete time nonlinear system of the controlled target as shown by the following formula is obtainable.

Formula 16

$$y(t)=\hat{a}_1(t)y(t-1)+\hat{a}_2(t)y(t-2)+\hat{b}_0(t)u(t-1) \tag{26}$$

With Equation (23), each of the parameters $\hat{a}_1(t)$, $\hat{a}_2(t)$, and $\hat{b}_0(t)$ is expressed with "m(t)", "k(t)", and "c(t)" each being a parameter of the interaction model as shown by the following formula.

Formula 17

$$\hat{a}_1(t) = \frac{2m(t) + c(t)T_s}{m(t) + c(t)T_s + k(t)T_s^2} \tag{27}$$

$$\hat{a}_2(t) = \frac{m(t)}{m(t) + c(t)T_s + k(t)T_s^2} \tag{28}$$

$$\hat{b}_0(t) = \frac{T_s^2}{m(t) + c(t)T_s + k(t)T_s^2} \tag{29}$$

The sign "$T_s$" denotes a sampling time.

Next, a direction $\theta_f(t)$ of a force occurring on the leading end of the attachment will be described.

Figure 10:
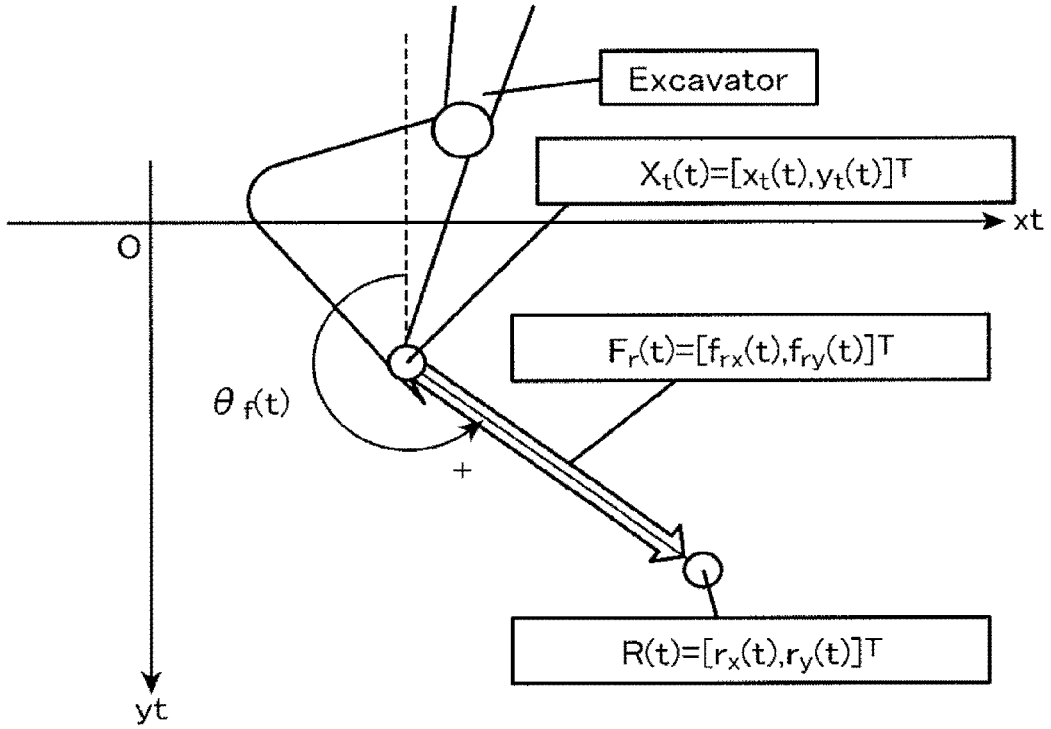
FIG. 10 shows a relation between a coordinate of a leading end of an attachment and a coordinate of a target position in Example.

Equation (23) shows a scalar value indicating a norm u(t) of the force. The direction $\theta_f(t)$ of the force is required to control the hydraulic excavator. The direction $\theta_f(t)$ of the force is determined by using the following formula from a relation between the coordinate "$X_t(t)=[X_t(t), y(t)]^T$" of the leading end of the attachment and the coordinate "$R(t)=[r_x(t), r_y(t)]$ of the target position as shown in FIG. 10.

Formula 18

$$\theta_f(t) = \begin{cases} \tan^{-1}\left(\dfrac{x_t(t) - r_x(t)}{y_t(t) - r_y(t)}\right) - \pi \\ (\text{if } x_t(t) < r_x(t) \wedge y_t(t) < r_y(t)) \\ \tan^{-1}\left(\dfrac{x_t(t) - r_x(t)}{y_t(t) - r_y(t)}\right) + \pi \\ (\text{if } x_t(t) \geq r_x(t) \wedge y_t(t) < r_y(t)) \\ \tan^{-1}\left(\dfrac{x_t(t) - r_x(t)}{y_t(t) - r_y(t)}\right) \\ (\text{otherwise}) \end{cases} \tag{30}$$

Moreover, a force vector $F_r(t)$ of the force is determined by the following formula with: the u(t) calculated by Equation (3); and Equation (30). This leads to achieved control of the hydraulic excavator.

Formula 19

$$F_r(t)=u(t)[\sin\theta_f(t), \cos\theta_r(t)]^T \tag{31}$$

Subsequently, a simulation performed for inspection of Example will be described.

Figure 11:
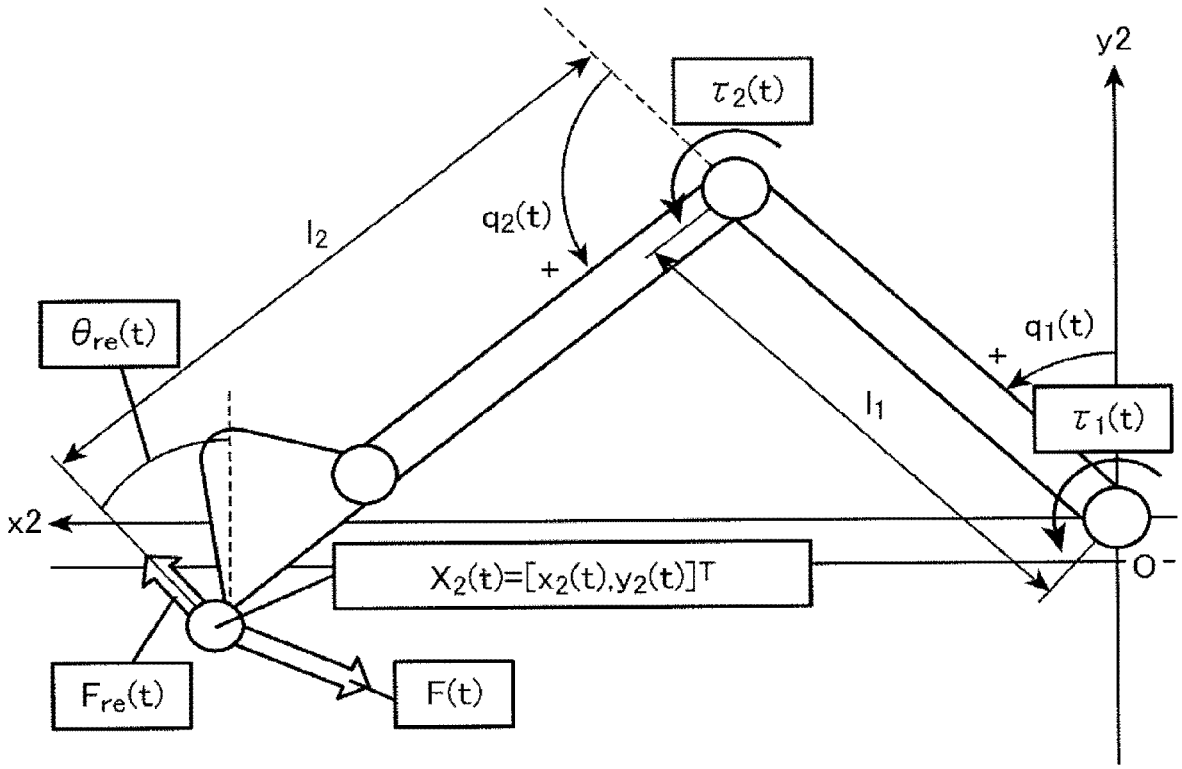
FIG. 11 illustrates an overview of an inspection model.

The simulation adopts an inspection model defining excavation as a target work. FIG. 11 illustrates an overview of the inspection model. The inspection model defines the attachment as a stiff-body two-linked manipulator in terms of simplification of the configuration. An equation of motion of the inspection model is expressed as follows.

Formula 20

$$\tau(t)+J(t)^T F_{re}(t)=M(t)\ddot{q}(t)+s(\dot{q}(t),q(t)) \tag{32}$$

Here, the equation "$\tau(t)=[\tau_1(t), \tau_2(t)]^T$" indicates a joint torque at a time t. The sign "$F_{re}(t)$" denotes an excavation counterforce. The sign "M(t)" denotes an inertia matrix. The equation "$q(t)=[q_1(t), q_2(t)]^T$" shows a joint angle. The sign "$s(q\cdot(t), q(t))$" denotes a speed square term and a gravity term. The sign "J(t)" denotes a Jacobian matrix. The excavation counterforce $F_{re}(t)$ is calculated with the following formula by using a passive earth pressure $F_{rp}(t)$ of Rankine.

Formula 21

$$F_{rp}(t) = \frac{1}{2}\gamma_s(t)h(t)^2\tan^2\left(\frac{\pi}{4} + \varphi_s(t)\right) \tag{33}$$

The sign "$\gamma_s(t)$" denotes a unit volume weight of soil. The sign "h(t)" denotes a retaining wall height. The sign "$\varphi_s(t)$" denotes an internal friction angle of the soil. Each of the signs "$\gamma_s(t)$" and "$\varphi_s(t)$" denotes a parameter changing depending on a soil quality. The retaining wall height h(t) is calculated from a geometric relation between a soil amount in the bucket and the bucket angle. When the excavation counterforce $F_{re}(t)$ is presumed to occur in a direction perpendicularly intersecting an opening plane of the bucket on the distal end of the bucket, the excavation counterforce $F_{re}(t)$ is expressed by the following formula.

Formula 22

$$F_{re}(t) = F_{rp}(t)[\sin\theta_{re}(t), \cos\theta_{re}(t)]^T \tag{34}$$

$$\theta_{re}(t) = q_1(t) + q_2(t) + \frac{\pi}{2} \tag{35}$$

Further, establishment of an initial database using the inspection model shown in FIG. 11 will be described. First, the distal end of the bucket is moved along a predetermined target locus. Here, a joint torque is generated under a PD control, and the distal end of the manipulator follows. FIG. 12 is a table showing a value of each parameter used in the establishment of the initial database. The parameter is calculated by the recursive least squares from chronological data of: a norm u(t) of an excavation force under each condition; and a norm y(t) of a position of the distal end of the manipulator that is a reference of an excavation start point. The calculated parameter is stored as an initial database.

Next, an inspection result will be described.

A result of comparison between Comparative Example based on a fixed parameter and Example will be described. Various parameters shown in FIG. 12 were used for the inspection. A value of a soil quality parameter was set as follows in accordance with a change in a soil quality depending on an excavation depth.

Formula 23

$$[\gamma_s(t), \varphi_s(t)] = \begin{cases} [19\times10^3, 0.471] \\ (\text{if } y_{2th1} < y_2(t)) \\ [24\times10^3, 0.593] \\ (\text{if } y_{2th2} < y_2(t) \leq y_{2th1}) \\ [28\times10^3, 0.733] \\ (\text{otherwise}) \end{cases} \tag{36}$$

Figure 13:
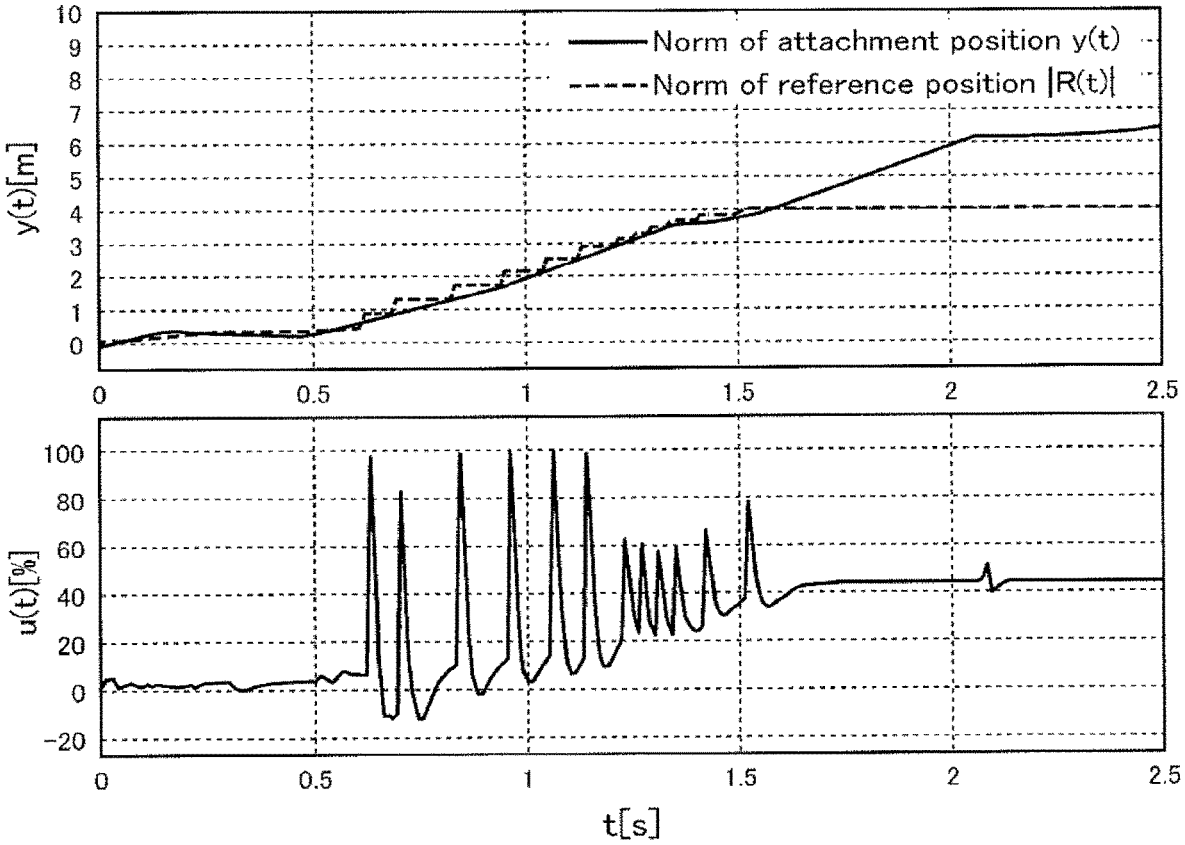
FIG. 13 is a graph showing a simulation result of a fixed parameter controller.

Each of the signs "$y_{2th1}$" and "$y_{2th2}$" denotes a coordinate of the leading end of the attachment whose soil quality parameter is changed. Each of FIG. 13 and FIG. 14 is a graph showing a simulation result in Comparative Example.

Figure 14:
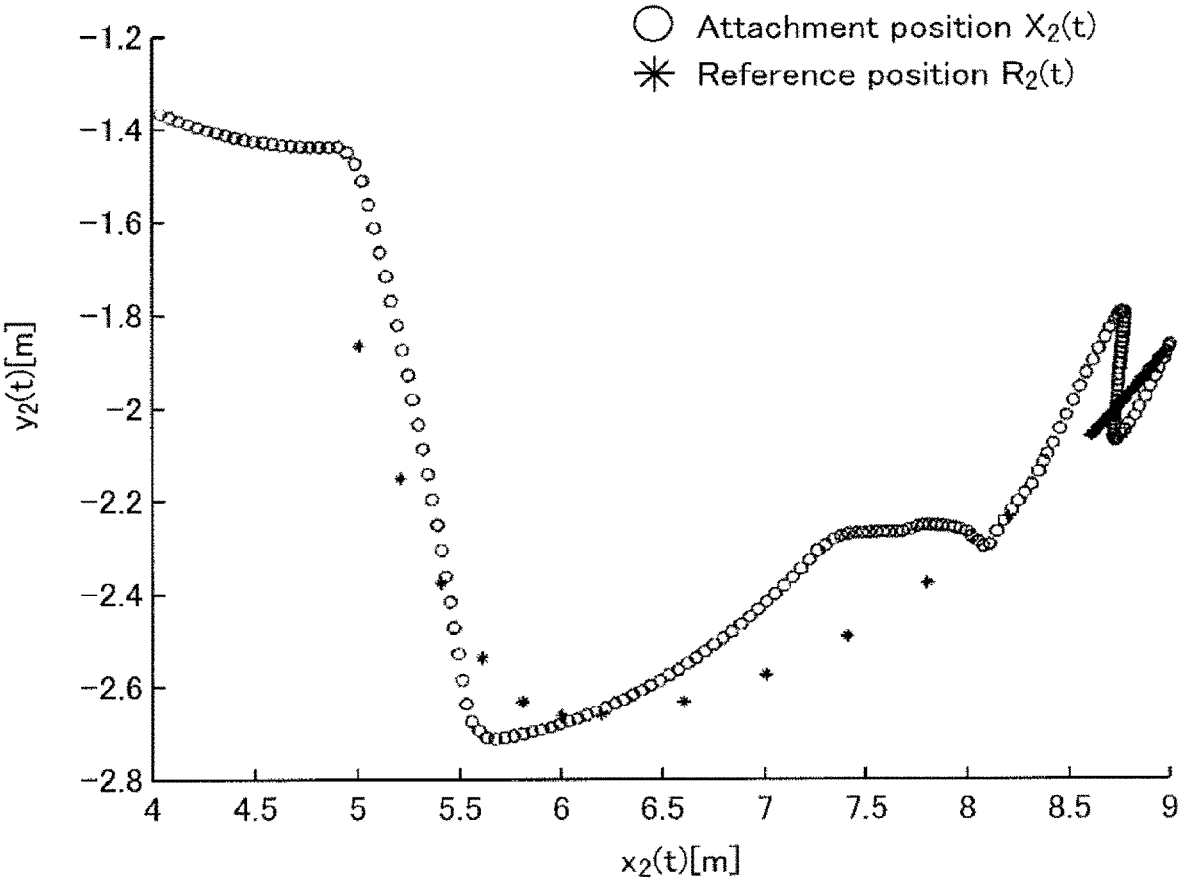
FIG. 14 is a graph showing a simulation result of a fixed parameter controller.
Figure 15:
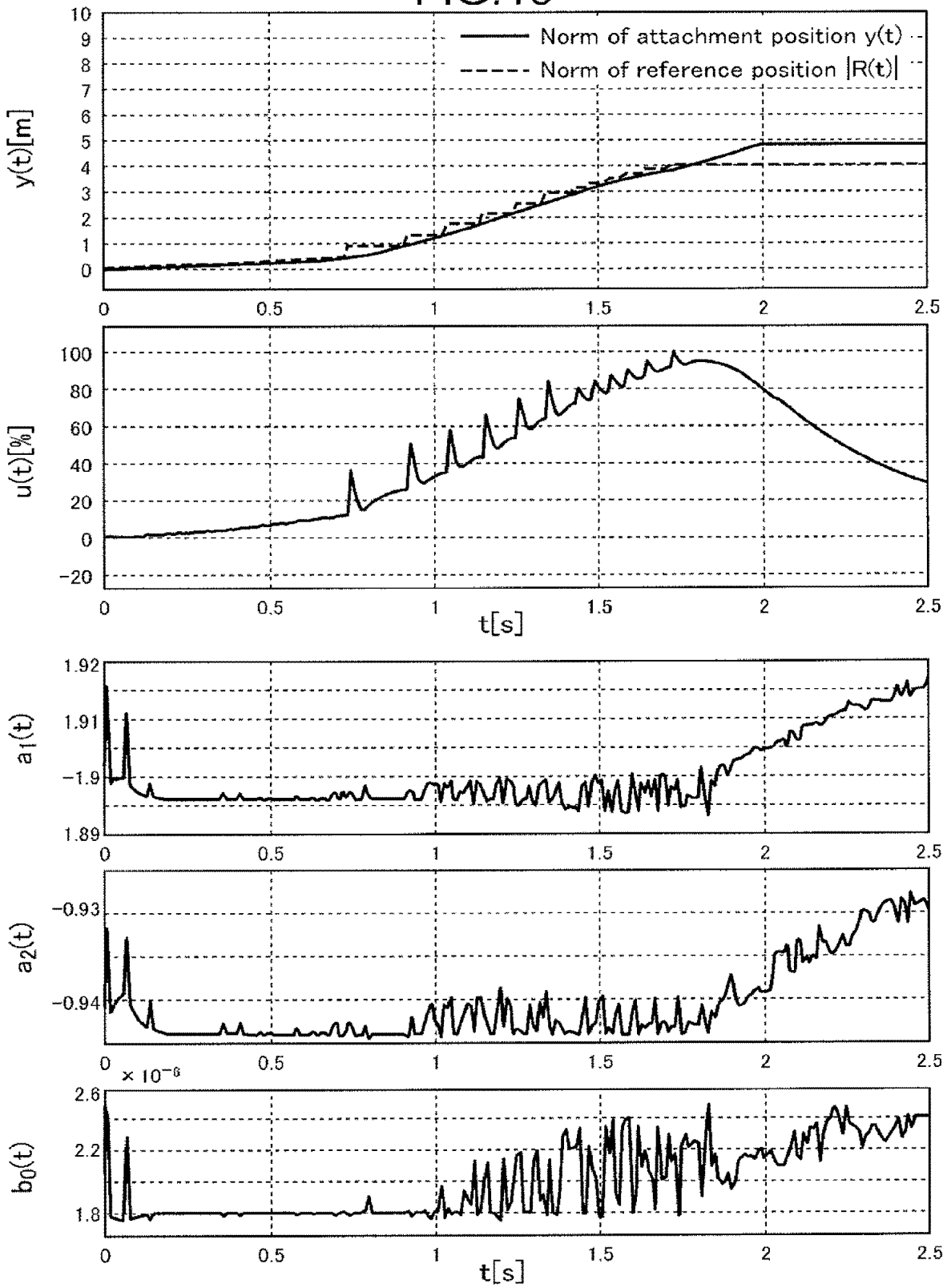
FIG. 15 is a graph showing a simulation result in Example.
Figure 16:
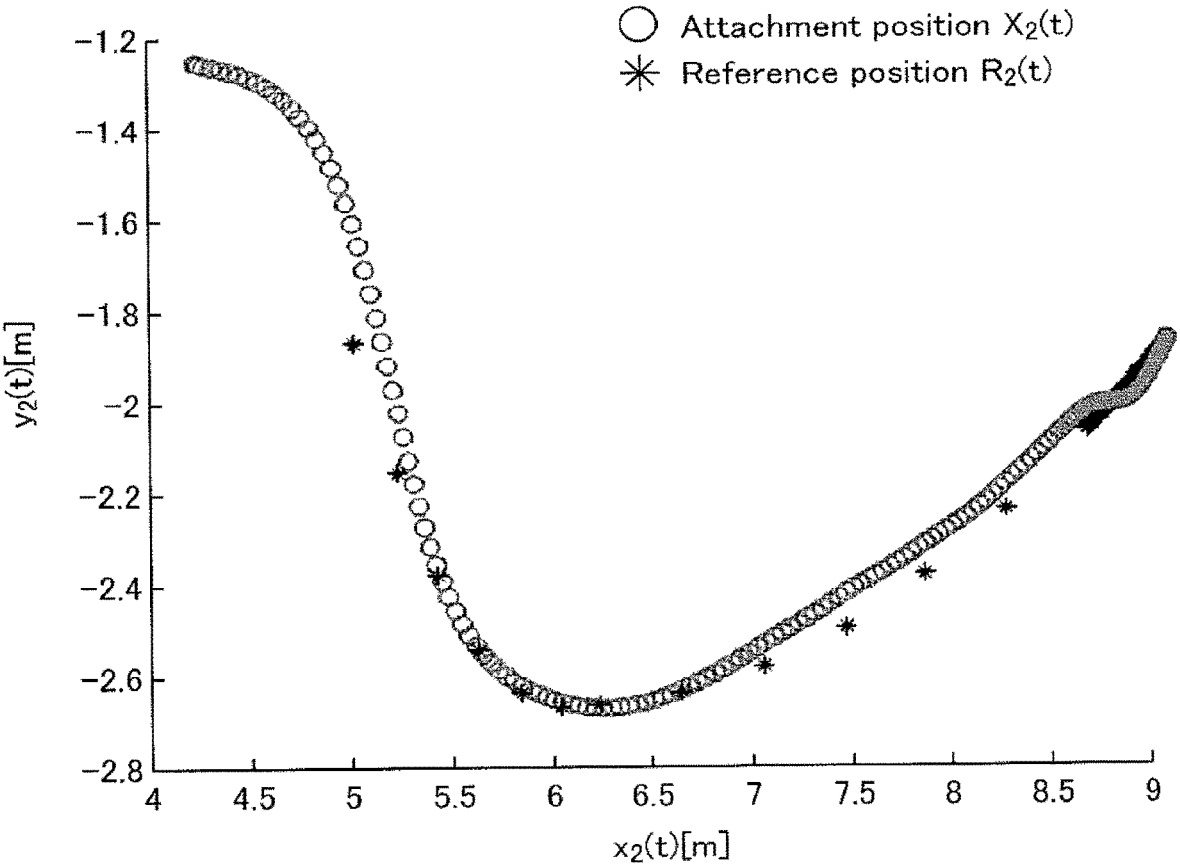
FIG. 16 is a graph showing a simulation result in Example.

Each of FIG. 15 and FIG. 16 is a graph showing a simulation result in Example. In each graph, a norm u(t) of a force to be input to the hydraulic excavator is normalized by setting a maximum value to 100%. In FIG. 14 and FIG. 16, "$X_2(t)$" denoted by the mark "○" and "$R_2(t)$" denoted by the mark "*" respectively represent a coordinate of the leading end of the attachment and a target coordinate in a coordinate system of the manipulator in FIG. 11.

As shown in FIG. 14, Comparative Example fails to express characteristics of a controlled target that sequentially change, and hence, the followability to the target locus is low. Further, as shown in FIG. 13, a fluctuation is seen in the norm u(t) of the input force. By contrast, as shown in FIG. 16, in Example, parameters are calculated one after another in accordance with a change in a posture of the attachment or a change in the soil quality as shown in FIG. 15. Moreover, the fluctuation in the norm u(t) of the input force is suppressed more effectively in comparison with the fluctuation in use of the fixed parameter controller. It is understood that Example is more suitable for mounting than Comparative Example from the viewpoint of the preference of a stable value of the norm u(t) of the input force in the mounting. The inspection confirmed improvement in the followability to the target locus in Example by 61% in comparison with the followability in Comparative Example. Conclusively, the way in Example was confirmed to be adaptable to a change in a work object which is unpredictable and chronologically changes, and accordingly, the way can achieve excavation along the target locus.

SUMMARY OF EMBODIMENT

An automatic operating device according to one aspect of the present invention is an automatic operating device for a working machine including a working device having a portion to interact with an object. The automatic operating device includes: an acquisition part that acquires actual position data indicating an actual position of the portion; an estimation part that estimates estimative actual position data by inputting estimative force data to a first model defining a relation between force data indicating a force to occur on the portion and the actual position data by using a first parameter indicating characteristics of the interaction; a calculation part that calculates a deviation between: target position data indicating a target position of the portion; and a difference between the estimative actual position data and the actual position data; a computation part that computes estimative force data by inputting the deviation to a second model defining a relation between the deviation and force data for causing the actual position to meet the target position by using the first parameter; a setting part that calculates a second parameter corresponding to the estimative actual position data and the estimative force data on the basis of a first parameter having been calculated in past, and sets the first parameter on the basis of the second parameter; and an instructive value calculation part that calculates an instructive value to the working machine from the estimative force data.

According to this configuration, the second parameter corresponding to the estimative force data computed by using the second model and the actual position data acquired by the acquisition part is calculated on the basis of the first parameter having been calculated in past, and the second parameter is set as the first parameter of each of the first model and the second model. Then, the estimative force data for causing an interactive portion to reach the target position is computed by using the second model having the set first parameter, an instructive value to the working machine is calculated on the basis of the computed estimative force data, and the instructive value is input to the working device. Here, a relation between the actual position data and the force data includes characteristics of the interaction. Thus, the first parameter corresponding to the actual position data and the estimative force data reflects the characteristics of the interaction. In this manner, the first parameter reflecting the characteristics of the interaction is settable for each of the first model and the second model. This results in enabling the working machine to generate an appropriate force for causing a position of the interactive portion to meet the target position in consideration of the characteristics of the interaction.

In the automatic operating device, each of the estimative force data and the estimative actual position data is preferably a norm.

According to this configuration, each of an output variable of the second model, and input and output variables of the first model is one-dimensionally expressed, and thus, each of the second model and the first model is in a simple model form.

In the automatic operating device, each of the actual position data and the target position data preferably includes coordinate data. The automatic operating device preferably further includes a direction calculation part that calculates, on the basis of the coordinate data indicated by the actual position data and the coordinate data indicated by the target position data, a direction of the force occurring on the portion. The instructive value calculation part preferably calculates, on the basis of the direction of the force and the norm of the estimative force data, a vector of the force occurring on the portion, and calculates the instructive value including the force vector.

According to this configuration, a direction of the force occurring on the instructive portion is calculated on the basis of the coordinate data of the actual position and the coordinate data of the target position, and a force vector is calculated from the calculated direction of the force and the norm of the estimative force data computed by the computation part, and the instructive value including the calculated force vector is input to the working machine. Consequently, the direction of the force as well as the degree of the force can be instructed to the working machine, and an appropriate operation of the working machine is attainable.

In the automatic operating device, the first parameter is preferably defined by using a mass of the interaction and at least one of a spring constant and a viscosity coefficient each showing the interaction.

According to this configuration, the first parameter is defined by using the mass of the interaction and at least one of the spring constant and the viscosity coefficient each showing the interaction. In this manner, the first model and the second model can more accurately reflect the characteristics of the interaction.

In the automatic operating device, the acquisition part preferably acquires, from the working machine, a notification indicating a start of the interaction, and the estimation part, the calculation part, the computation part, the setting part, and the instructive value calculation part preferably sequentially execute the respective performances thereof during the interaction.

According to this configuration, the parameter is updated one after another during the occurrence of the interaction. Therefore, the first parameter suitable for the characteristics of the interaction that change one after another is set for each of the first model and the second model, resulting in enabling the working machine to generate a force suitable for the characteristics of the interaction.

In the automatic operating device, the calculation part preferably calculates, as the deviation, a difference between: a norm of the target position data; and a difference between a norm of the actual position data and a norm of the estimative actual position data.

According to this configuration, the difference between: the norm of the target position data; and the difference between the norm of the actual position data and the norm of the estimative position is calculated as the deviation. Hence, the deviation being an input variable of the second model is one-dimensionally formable, and therefore, a simple configuration of the second model is attainable.

In the automatic operating device, the portion preferably includes a leading end of the working device.

This configuration achieves occurrence of an appropriate force for causing a position of the distal end of the working device to meet the target position in the working device in consideration of the characteristics of the interaction.

In the automatic operating device, it is preferable that the working machine includes a hydraulic excavator, the object includes soil and sand, and the force includes an excavation force.

This configuration enables the hydraulic excavator to generate an appropriate excavation force for causing the position of the distal end of the working device to meet the target position in consideration of the characteristics of soil and sand.

The automatic operating device preferably further includes a database that stores the first parameter having been calculated in past.

This configuration includes the database that stores the first parameter having been calculated in past, and therefore, the first parameter having been calculated is easily acquirable.

The invention claimed is:

1. An automatic operating device for a working machine including a working device having a portion to interact with an object, the automatic operating device comprising:

a processor, the processor being configured to acquire actual position data indicating an actual position of the portion, estimate estimative actual position data by inputting estimative force data to a first model defining a relation between force data indicating a force to occur on the portion and the actual position data by using a first parameter indicating characteristics of an interaction between the portion and the object, calculate a deviation between: target position data indicating a target position of the portion; and a difference between the estimative actual position data and the actual position data, compute estimative force data by inputting the deviation to a second model defining a relation between the deviation and force data for causing the actual position to meet the target position by using the first parameter, calculate a second parameter corresponding to the estimative actual position data and the estimative force data based on a parameter having been calculated in past, and sets the first parameter based on the second parameter, calculate an instructive value to the working machine from the estimative force data, and control operation of the working machine based on inputting of the instructive value.

2. The automatic operating device according to claim 1, wherein each of the estimative force data and the estimative actual position data is a norm.

3. The automatic operating device according to claim 2, wherein each of the actual position data and the target position data includes coordinate data, and the processor is further configured to:

calculate, based on the coordinate data indicated by the actual position data and the coordinate data indicated by the target position data, a direction of the force occurring on the portion, and calculate, based on the direction of the force and the norm of the estimative force data, a force vector occurring on the portion, and calculates the instructive value including the force vector.

4. The automatic operating device according to claim 2, wherein the first parameter is defined by using a mass of the interaction and at least one of a spring constant and a viscosity coefficient each showing the interaction.

5. The automatic operating device according to claim 2, wherein the processor is further configured to:

acquire, from the working machine, a notification indicating a start of the interaction, and repeatedly execute the acquiring of the actual position data, the estimating of the estimative actual position data, the calculating of the deviation, the computing of the estimative force data, the calculating of the second parameter, the calculating of the instructive value, and the inputting of the instructive value during the interaction.

6. The automatic operating device according to claim 2, wherein the calculating of the deviation includes calculating, as the deviation, a difference between: a norm of the target position data; and a difference between a norm of the actual position data and the norm of the estimative actual position data.

7. The automatic operating device according to claim 1, wherein the portion includes a leading end of the working device.

8. The automatic operating device according to claim 1, wherein the working machine includes a hydraulic excavator, the object includes soil and sand, and the force includes an excavation force.

9. The automatic operating device according to claim 1, further comprising a database that stores the first parameter having been calculated in past.

* * * * *